United States Patent [19]

Moore et al.

[11] Patent Number: 4,775,052

[45] Date of Patent: Oct. 4, 1988

[54] CONTAINER RACK

[76] Inventors: Larry Moore, 9831 Inglewood Crescent, Chilliwack, British Columbia, Canada; Paul E. Ferris, 9527 Broadway Street, Chilliwack, British Columbia, Canada, V2P 5T8

[21] Appl. No.: 742,539

[22] Filed: Jun. 6, 1985

Related U.S. Application Data

[63] Continuation of Ser. No. 409,449, Aug. 19, 1982, abandoned.

[51] Int. Cl.[4] ..... E05B 73/00

[52] U.S. Cl. ..... 211/4; 211/13; 211/71

[58] Field of Search ..... 211/46, 43, 4, 13, 71; 20/68, 59

[56] References Cited

U.S. PATENT DOCUMENTS

| | | | |
|---|---|---|---|
| 538,500 | 4/1895 | Bulkley | 211/43 X |
| 3,622,012 | 11/1971 | Landgren | 211/126 |
| 3,785,185 | 1/1974 | Kerr | 70/68 |
| 4,262,810 | 4/1981 | Ilich | 211/46 X |

FOREIGN PATENT DOCUMENTS

| | | | |
|---|---|---|---|
| 278620 | 3/1914 | Fed. Rep. of Germany | 70/59 |
| 360888 | 4/1921 | Fed. Rep. of Germany | 211/43 |
| 261537 | 11/1926 | United Kingdom | 211/43 |

*Primary Examiner*—Ramon S. Britts
*Assistant Examiner*—Blair Johnson
*Attorney, Agent, or Firm*—Hughes, Cassidy & Multer

[57] ABSTRACT

A container rack for lockably storing and organizing containers equipped with lockable closure members, particularly bank night deposit bags with lockable zippers. A first container support having a first rod element is fixed to a base support and is adapted to lockably, slideably receive a container. A second container support having a second rod element is fixed to the base support in spaced, parallel relationship with the first rod element. Containers lockably supported by the first rod element are aligned relative to one another by the second rod element.

9 Claims, 1 Drawing Sheet

CONTAINER RACK

This is a continuation of application Ser. No. 409,449 filed Aug. 19, 1982, now abandoned.

FIELD OF THE INVENTION

This invention relates to racks for lockably storing and organizing containers equipped with lockable closure members. More particularly, this invention relates to a rack for lockably storing and organizing bank deposit bags.

BACKGROUND OF THE INVENTION

Banks have for some time provided certain customers with special deposit bags which are used to make deposits after normal banking hours. Each bag has a lockable closure member (typically a lockable zipper). The customer is also provided with a key which will open only the lock on his particular bag. The bank retains a master key or keys so that it may open the locks on the bags of all of its customers. Each bag is identified with a number unique to the particular customer to whom the bag is allocated by the bank.

The customer may place cash, receipts, etc. in his bag, lock the bag, and place the locked bag in the bank's night deposit vault. Eventually, the bank employees open the vault, remove and empty the bags, which are then left in a pile. To retrieve his bag, a customer must usually wait while a bank employee sorts through the pile of empty bags for the bag bearing that customer's identification number.

The present invention eliminates the need for a bank employee to locate the customer's bag and provides a means for organizing the bags in a compact, orderly manner so that customers may retrieve their own (and only their own) bags after the bank employees have emptied the bags.

SUMMARY OF THE INVENTION

The present invention provides a container rack comprising base support means and first container support means supported by the base support means. The first container support means is adapted to lockably receive a container.

Advantageously, the first container support means is further adapted to slidably receive the container.

The container rack may also include second container support means supported by the base support means. Containers slidably, lockably supported by the first container support means are aligned relative to one another by the second container support means.

Preferably, the first container support means comprises a first rod element and the second container support means comprises a second rod element. The first and second rod elements are fixed in spaced, parallel relationship on the base support means.

Advantageously, the base support means includes a pair of opposed, vertically extending side arm members. The first and second rod elements are fixed in spaced, parallel relationship between the side arm members.

In the preferred embodiment, the container is a bank deposit bag having a lockable closure member, and the first rod element is adapted to engage the lockable closure member such that the bank deposit bag may be locked to and slidably supported by the first rod element.

The present invention also provides a container support rack for containers having lockable closure members. The rack comprises first and second container support means and base support means for supporting the first and second container support means in fixed, parallel relationship relative to one another. The first container support means is adapted to engage the lockable closure members such that the containers may be locked to and slidably supported by the first container support means. The containers preferably are bank deposit bags.

DETAILED DESCRIPTION WITH REFERENCE TO THE DRAWINGS

The preferred embodiment to be described is a container rack to which a bank deposit bag equipped with a lockable closure member may be locked. However, this description is not to be taken as limiting the invention; the invention has application to other situations in which containers equipped with lockable closure members are to be attached to a supporting rack.

Figure 1:
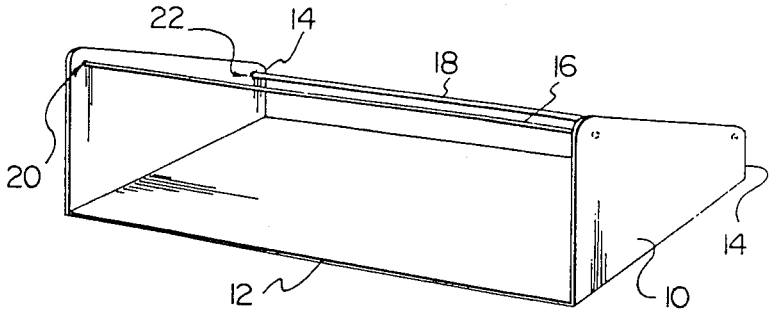
FIG. 1 is a perspective view showing a preferred embodiment of a container rack in accordance with the present invention.
Figure 2:
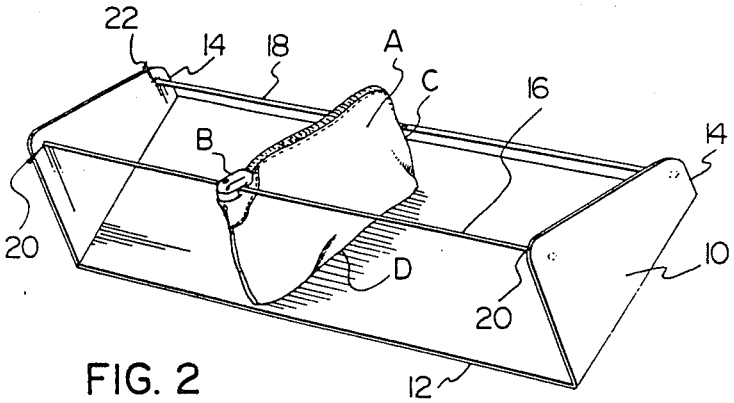
FIG. 2 is a perspective view of the container rack of FIG. 1, showing a container lockably supported by the rack.

FIGS. 1 and 2 show a container rack 10, having a base support means including base plate 12 and a pair of opposed, vertically extending side arm members 14. First rod element 16 and second rod element 18 are fixed in spaced, parallel relationship between side arm members 14. First rod element 16 is fixed between side arm members 14 toward their upper corners 20. Second rod element 18 is fixed between side arm members 14 somewhat beneath the level of corners 20. Metal rods of circular cross-section, 5/32" in diameter, have been found suitable for forming first rod element 16 for use with bank deposit bags of the type typically used by Canadian chartered banks. Metal rods of circular cross-section, ½" in diameter, have been used to form second rod element 18.

Figure 3:
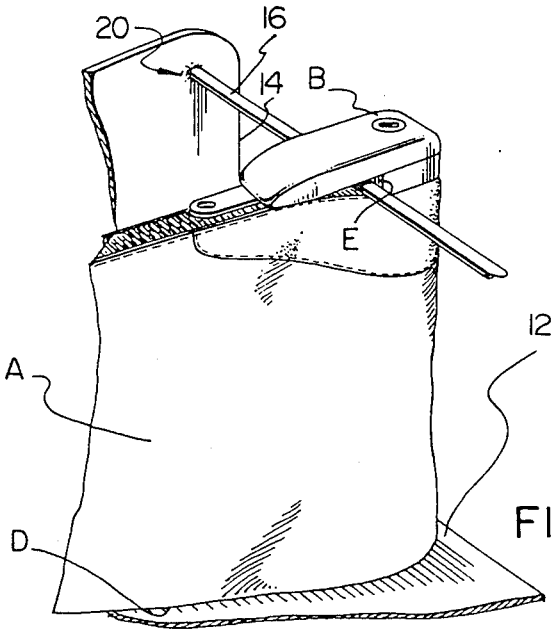
FIG. 3 is an enlarged side elevation view showing in detail the relationship between the container lockable closure member and rack, when the container is lockably, slidably received by the rack.

FIGS. 2 and 3 show a container A (a typical bank deposit bag is illustrated) having a lockable closure member, namely, locking zipper B which may be lockably received by first rod element 16. As can be seen in FIG. 3, locking zipper B includes an aperture E through which first rod element 16 is slidably received. First rod element 16 is fitted into aperture E when locking zipper B is unlocked. Locking zipper B is then locked over first rod element 16, such that container A is slidably, lockably supported by first rod element 16. Side arm members 14 prevent removal of container A over the ends of first rod element 16.

With container A slidably, lockably supported by first rod element 16, lower surface D of container A rests on and is supported by base plate 12, and container end C, as shown in FIG. 2, contacts and is supported by second rod element 18.

Although only one container A is shown attached to first rod element 16, it is to be understood that many such containers may be lockably fastened beside one another on first rod element 16. Second rod element 18 serves to support the container ends and to maintain alignment of the containers relative to one another. When fixed between side arm members 14, second rod element 18 also assists in maintaining the side arm members in rigid, spaced parallel relationship.

It is contemplated that when the container rack is used with bank deposit bags, the bank employees will lock the bags to the container rack after removing the contents. Because the bags are numbered, they may be locked onto the container rack in numerical sequence. If the rack is placed upon a counter in the bank, customers may quickly identify their own bags and, using their keys, may unlock their bags and remove them from the rack. Customers should not require the services of a bank employee to retrieve their bags. Because a customer's key will unlock only his own bag, the security of the system is assured.

Although the container rack as illustrated forms an oblong type of structure, various other configurations may be used. For example, a circular carousel type of structure might be provided to conserve space.

It will be readily apparent to those skilled in the art that various modifications to the embodiment described and shown in the drawings can be made without departing from the spirit and scope of the invention as defined in the following claims.

We claim:

1. A combination of a security container and a support rack on which the container can be placed and locked for later retrieval, the combination being characterized as follows:

a. said security container having an access opening and a lockable closure member, said closure member having an open position permitting access to the contents of the container and a closed position where said closure member closes the access opening and can be locked to securely close the container, said container being characterized in that with the closure member locked in its closed position, the closure member defines a locked closed through aperture, and with the closure member unlocked, said aperture is open;

b. said support rack comprising:

1. a base defining a container receiving area where the container can be placed with its closure member in its locked position being at a securing location;

2. a rod member attached to said base and extending through said securing location, said rod member being sized to fit in said aperture when the closure member is locked in it closed position;

whereby the container can be placed on the rack and the closure member moved into its closed position and locked, with the rod member positioned in the closed aperture, so that the container is securely held to the rack, and the container can be removed from the rack by unlocking the closure member and moving the container out of engagement with the rod member, after which the container can be removed from the rack.

2. The combination as recited in claim 1, wherein said base comprises a base plate and two side walls extending upwardly from said base plate, with the container receiving area being positioned between said walls and through said container receiving area.

3. The combination as recited in claim 2, wherein said container comprises a bank bag, and said closure member comprises a locking zipper which in its locked position defines said aperture as being positioned between said locking zipper and said bag.

4. The combination as recited in claim 3, wherein said side walls are spaced from one another a sufficient distance so that a pluralty of bags can be placed in said container receiving area in side-by-side relationship, with each of said bags being securely held to the rack.

5. The combination as recited in claim 1, wherein said container comprises a bank bag, and said closure member compriss a locking zipper which in its locked position defines said aperture as being positioned between said locking zipper and said bag.

6. A method of presenting a plurality of security containers at a location where the containers can be placed and locked for later retrieval, wherein the containers each have an access opening and a lockable closure member, said closure member having an open position permitting access to the contents of the container and a closed position where said closure member closes the access opening and can be locked to securely close the container, said container being characterized in that with the closure member locked in its closed position, the clousre member defines a locked closed through aperture, and with the closure member unlocked, said aperture is open, said method comprising:

a. providing a support rack comprising:

1. a base defining a container receiving area where each container can be placed with its closure member in its closed position being at a securing location;

2. a rod member attached to said base and extendingthrough said securing location, said rod member being sized to fit in said aperture when the closure member is locked in its closed position;

b. placing each container on the rack and moving its closure member into its closed position, with the rod member positioned in the closed aperture, and locking the closure member so that the container is securely held to the rack, with the container being able to be removed from the rack by unlocking the closure member and moving the container out of engagement with the rod member, after which the container can be removed from the rack.

7. The method as recited in claim 6, wherein said base comprises a base plate and two side walls extending upwardly from said base plate, said method further comprising placing the containers in the container receiving area which is located between said side walls, with said rod member extending between said side walls and through said container receiving area.

8. The method as recited in claim 7, wherein said containers comprise bank bags, and said closure member comprises a locking zipper which in its locked position defines said aperture as being positioned between said locking zipper and its related bag.

9. The method as recited in claim 6, wherein said containers comprise bank bags, and said clousure member comprises a locking zipper which in its locked position defines said aperture as being positioned between said locking zipper and its related bag.

* * * * *